US006457802B2

(12) United States Patent
Jackson

(10) Patent No.: US 6,457,802 B2
(45) Date of Patent: Oct. 1, 2002

(54) SYSTEM AND METHOD FOR MAINTAINING THE FRONT OF A FLUID JET DEVICE IN A RELATIVELY CLEAN CONDITION

(75) Inventor: Philip H. Jackson, Cookeville, TN (US)

(73) Assignee: Illinois Tool Works Inc., Glenview, IL (US)

( * ) Notice: Subject to any disclaimer, the term of this patent is extended or adjusted under 35 U.S.C. 154(b) by 24 days.

(21) Appl. No.: 09/775,237

(22) Filed: Feb. 1, 2001

Related U.S. Application Data

(63) Continuation-in-part of application No. 09/590,742, filed on Jun. 8, 2000.

(51) Int. Cl.[7] ..... B41J 2/165
(52) U.S. Cl. ..... 347/35
(58) Field of Search ..... 347/22, 30, 35, 347/25, 28, 29

(56) References Cited

U.S. PATENT DOCUMENTS

| | | | |
|---|---|---|---|
| 4,367,479 | A | 1/1983 | Bower |
| 4,479,136 | A | 10/1984 | Lewis et al. |
| 4,528,996 | A | 7/1985 | Jones |
| 5,184,147 | A | 2/1993 | Maclane et al. |
| 6,164,752 | A | 12/2000 | Schaefer et al. |
| 6,196,657 | B1 | 3/2001 | Hawkins et al. |
| 6,283,575 | B1 | 9/2001 | Hawkins et al. |
| 2001/0050697 | A1 | 12/2001 | Jackson |

FOREIGN PATENT DOCUMENTS

| | | |
|---|---|---|
| EP | 0 361 393 | 4/1990 |
| EP | 0 968 827 | 1/2000 |
| EP | 0 968 828 | 1/2000 |
| EP | 0 997 291 | 5/2000 |
| EP | 1 086 815 | 3/2001 |
| GB | 2 339 170 | 1/2000 |
| JP | 361248750 | 6/1986 |
| JP | 10202908 | 4/1998 |
| JP | 10138515 | 5/1998 |
| WO | 97/30850 | 8/1997 |
| WO | 01/08888 | 2/2001 |

*Primary Examiner*—John Barlow
*Assistant Examiner*—Ly T Tran
(74) *Attorney, Agent, or Firm*—Lisa M. Soltis; Mark W. Croll; Donald J. Breh

(57) ABSTRACT

A purge/clean system and an associated method for A fluid jet apparatus, such as an ink jet printing system, having a fluid chamber including a chamber wall having an exterior surface and at least one orifice through which fluid is ejected from the fluid chamber toward a substrate involves a cavity defined adjacent the exterior surface of the chamber wall into which fluid which is, expelled from the at least one orifice during a purging or cleaning operation is permitted to flow and a vacuum pump for withdrawing fluid which is contained within the cavity. The cavity can be provided by a plurality of plate arranged in an assembled, or stacked, relationship against the exterior surface of the chamber wall and, with the aid of a fan or compressor, can be used to create a zone of above-atmospheric pressure adjacent the exterior surface of the printer head. With the zone of above-atmospheric pressure created within the cavity, any leakage of air from the region into the atmosphere effects a flow of air out of the region and thereby helps to maintain the at least one orifice in a relatively clean condition.

25 Claims, 6 Drawing Sheets

SYSTEM AND METHOD FOR MAINTAINING THE FRONT OF A FLUID JET DEVICE IN A RELATIVELY CLEAN CONDITION

This is a continuation-in-part of application Ser. No. 09/590,742, filed Jun. 8, 2000, now U.S. Pat. No. 6,406,125.

BACKGROUND OF THE INVENTION

This invention relates generally to the field of fluid jetting systems and relates, more particularly, to the means and methods used to maintain a fluid jet device of a fluid jetting system in proper working order.

An example of a fluid jet device with which this invention is concerned is a printer head of an ink jet printer. In some instances, such a printer head relies upon capillary action to move a working fluid (e.g. ink) to the printer head and includes means mounted within the head for directing ink through an orifice toward a target substrate. Such ink-directing means can include an actuator, such a piezoelectric device or an electrostatic membrane, for directing ink through an orifice upon appropriate actuation of the actuator or, in the alternative, can include a thermal device wherein heat, which is applied to the ink, serves as the mechanism for directing ink through an orifice.

Commonly, a fluid chamber, or ink flow passageway, is provided in the printer head which conducts ink from a source, by way of a conduit connected between the source and the printer head, and past the ink-directing means to the orifice. During normal operation of the printer head, ink must be present in the ink flow passageway so that operation of the ink-directing means effects a drawing of ink into the passageway and a subsequent pushing of ink, under pressure, through the orifice and toward a target surface. If, however, air enters the ink flow passageway through the orifice (as could be the case if the printing head were accidentally struck or jostled) or if the orifice becomes blocked, for example, by debris or dirt which may become lodged within the orifice, operation of the ink-directing means neither draws additional ink into the passageway, nor effectively pushes ink through the orifice. Consequently, for effective operation of the printer head, the ink flow passageway must be devoid of air, and the orifices of the printer head must remain free of blockage.

Air which is present in an ink flow passageway of a printer head and any blockage (surface or internal blockage) of the orifices of a printer head is commonly removed by a purging or head-cleaning operation which requires that additional ink be forced through the conduit and ink flow passageways by way of a purge bulb, pump or other means for forcing ink through the conduit and toward the printer head orifices. Such a purging or head-cleaning process, however, normally pushes ink, as well as air or blockage matter (e.g. debris), through the orifices so that ink, which is pushed from the orifices, flows downwardly along the front (i.e. the face plate) of the printer head. To prevent the ink which flows downwardly along the front of the printer head from touching or being smeared upon surfaces desired to remain free of ink, the ink is manually wiped from the front of the printing head with an absorbent sheet of material. However, such a purging and subsequent cleaning procedure requires manual intervention in, and disruption of, the printing operation and is usually a messy, undesirable job. Furthermore, if such a process is required to be performed on a printer head stationed along an assembly line, assembly line production may have to halted in order to satisfactorily service the printer head, thereby causing the loss of production time.

It would therefore be desirable to provide a new and improved system and method for maintaining the front of a printer head in a relatively clean condition, even when ink is pushed through the orifices of the printer head during a purging or head cleaning operation wherein air or blockage material is purged from the ink flow passageways.

Accordingly, it is an object of the present invention to provide a new and improved system and method for use when purging or cleaning a fluid chamber of a fluid jet apparatus, such as the printer head of an ink jet apparatus, for maintaining the front, or exterior surface of the fluid jet apparatus in a relatively clean condition.

Another object of the present invention is to provide such a system and method which facilitates a purging and cleaning operation in that such operations can be performed routinely upon the fluid jet apparatus without the messiness associated with purging and cleaning operations of the prior art.

Still another object of the present invention is to provide such a system and method which circumvents the need for wiping the front, or exterior surface of a fluid jet apparatus during a purging or cleaning operation performed upon the fluid jet apparatus.

Yet another object of the present invention is to provide such a system and method which is well-suited for automatic operation, thereby requiring no manual intervention, and can be performed without disruption of a fluid jetting operation or any assembly line operation with which the system and method are used.

A further object of the present invention is to provide a system and method which can be used to maintain an orifice of a fluid jet apparatus relatively free of blockage matter, such as debris or dirt.

A still further object of the present invention is to provide such a system which is uncomplicated in construction, yet effective in operation.

SUMMARY OF THE INVENTION

This invention resides in an apparatus and method for use when purging air or blockage from a fluid chamber of a fluid jet apparatus during a purging or cleaning operation, wherein the fluid chamber has a chamber wall with an exterior surface, an interior surface adjacent the fluid chamber, and at least one orifice through which fluid is ejected by the fluid jet apparatus during a jetting operation.

The apparatus includes a cavity adjacent the chamber wall, wherein the fluid which flows through the at least one orifice during a purging or cleaning operation flows from the at least one orifice into the cavity.

The method of the invention includes the steps of providing a cavity adjacent the exterior surface of the chamber wall into which fluid, which flows from the at least one orifice during a purging or cleaning operation, is permitted to flow from the at least one orifice, and withdrawing fluid which is contained within the cavity.

In another aspect of the apparatus and method, the cavity can be used to create a zone of above-atmospheric pressure in a region adjacent the exterior surface of the chamber wall so that leakage of air from said region helps to maintain the at least one orifice in a relatively clean condition. To this end, air is conducted, under pressure, to the interior of the cavity so that any leakage of air from the cavity into the atmosphere effects a flow of air out of the cavity.

Other features and advantages of the present invention will be apparent from the following detailed description, the accompanying drawings, and the appended claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
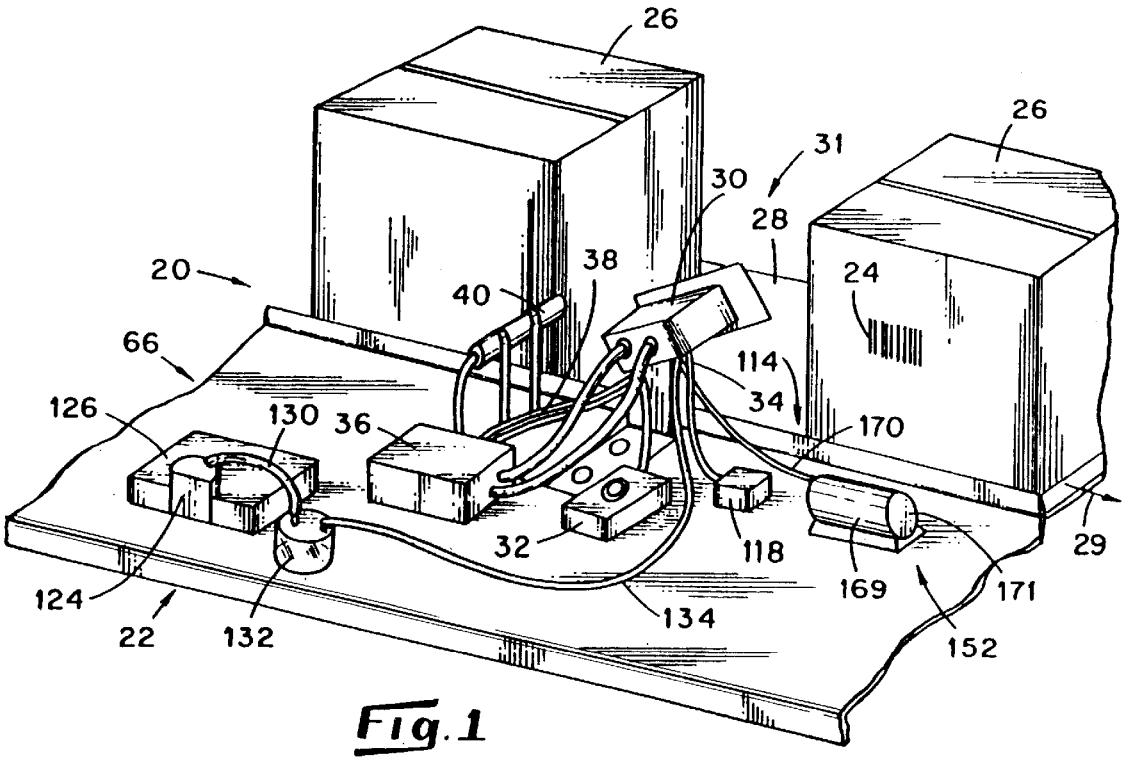
FIG. 1 is a perspective view of an ink jet printing system within which an embodiment of a purge/clean system in accordance with the present invention is utilized.

While the present invention is susceptible of embodiment in various forms, there is shown in the drawings and will hereinafter be described specific embodiments with the understanding that the present disclosure is to be considered an exemplification of the invention and is not intended to limit the invention to the specific embodiments illustrated. It should be further understood that the title of this section, normally, "Detailed Description of the Invention," relates to a requirement of the United States Patent and Trademark Office, and does not imply, nor should be referred to limit the subject matter disclosed and claimed herein.

Turning now to the drawings in greater detail and considering first FIG. 1, there is shown an ink jet printing system 20 within which an embodiment, generally indicated 22, of a purge/clean system is incorporated. Furthermore, the printing system 20 is shown utilized in a typical environment of use wherein the printing system 20 is used to print indicia, such as a bar code 24, upon the side of a carton 26 being moved along a moving conveyor 28 in the direction indicated by the arrow 29. To this end, the printing system 20 includes an ink jet printer head 30 mounted in a stationary condition adjacent the conveyor 28, a supply 32 of ink, and a conduit, or hose 34, for conducting the ink from the supply 32 to the printer head 30. In this connection, the ink is conducted through the conduit 34 to the head 30 by capillary action.

The printer head 30 of the depicted system 20 includes suitable ink-directing means, generally indicated 31, for directing ink through and out of the head 30 toward the surface of a target, such as the side of a carton 26. Although such ink-directing means 31 can take any of a number of forms, such as thermal ink jet mechanisms (such as are embodied in printer heads available from Canon U.S.A., Inc. under the trade designation "Bubble Jet") and electrostatic transducers, the ink-directing means 31 of the depicted system 20 is piezoelectric-based in that actuation of piezoelectric devices within the printer head 30 effects the movement of ink through and out of the head 30 toward the surface of a target, such as the side of a carton 26. Furthermore, although the system 20 described herein is an ink jet printing system, the principles of the present invention can be embodied in other fluid jetting systems. Accordingly, the principles of the present invention can be variously applied.

For controlling the actuation of the ink-directing means 31 of the printer head 30, a control box 36 containing suitable control circuitry (not shown) is mounted adjacent the printer head 30, a plurality of wires 38 extend between the printer head 30 and the control circuitry positioned within the control box 36. The printing system 20 is also provided with sensing means, including an electric eye 40, which is appropriately wired to the control box 36 for sensing the presence of a carton 26 moving along the conveyor 28. During operation of the printing system 20, the movement of a carton 26 along the conveyor 28 is detected by the electric eye 40 which, in turn, initiates a predetermined sequence of events leading to the actuation of the printer head 30. In particular, appropriate piezoelectric devices in the head 30 are actuated, as desired, to print the indicia 24 upon the side of the carton 26 following a period of time necessary for a carton 26 to move from the electric eye 40 to a desired position in front of the printer head 30. It follows, therefore, that the actuation of the printer head 30 is coordinated with the speed of the cartons 26 as they move along the conveyor 28.

Figure 2:
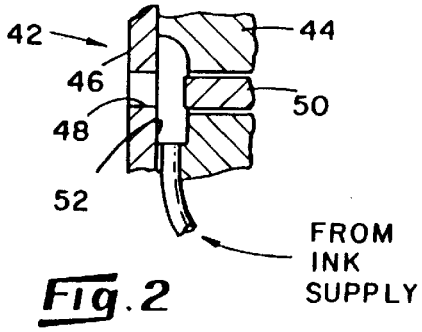
Fig. 2 PRIOR ART
FIG. 2 is a longitudinal cross-sectional view of a fragment of a printer head of the prior art illustrating schematically the components of the printer head disposed adjacent one embodiment of ink-directing means mounted within the head.

The structure and operation of a piezoelectric-based ink jet printer head is known so that a detailed description of them is not believed to be necessary. However, to enhance the appreciation of the contributions of the FIG. 1 purge/clean system 22, there is schematically illustrated in FIG. 2 a fragment of a prior art printer head 42 having a body 44, a face plate 46 defining an orifice 48 attached across the front of the body 44 and a piezoelectric device 50 mounted within the body 44 adjacent the orifice 48. In addition, there is defined within the body 44 an ink flow passageway 52 (or fluid chamber) along which ink is permitted to flow from an ink supply to the orifice 48. In the depicted head 42, the face plate 46 provides a chamber wall of the ink flow passageway 52, and the exterior surface of the face plate 46 provides the front of the head 42.

Due to the surface tension of the ink which normally spans the orifice 48 between operating cycles of the printer head 42, the ink normally does not flow out through the orifice 48 unless forced to do so. However, by energizing and de-energizing the piezoelectric device 50 so that the device 50 rapidly contracts and expands, ink is drawn into the passageway 52 from the supply and is then pushed, under pressure, through the orifice 48 toward the surface of a target. If, however, air is present in the ink passageway 52, expansion and contraction of the piezoelectric device 50 does not adequately draw ink into the passageway 52 where it can be subsequently pushed through the orifice 48. If, therefore, air is injected or drawn into the passageway 52 through the orifice 48 (as may be the case if the head 42 is jostled or struck by a carton 26 moving along the conveyor 28), the air must be purged from the passageway 52 to render the printer head 42 fully operable.

The printer head 42 is similarly rendered inoperable for its intended purpose if its orifice 48 is blocked with blockage matter, such as debris or dirt. More specifically, the blockage matter (which can be surface blockage that blocks the orifice 48 at the surface of the face plate 46 or internal blockage that becomes lodged within the orifice 48 or ink flow passageway 52) prevents the passage of ink out of the orifice 48 by the actuation of the piezoelectric device 50 and prevents the flow of ink through the passageway 52 of the head 42 in the desired manner. Therefore, in the event that the orifice 48 becomes blocked with blockage matter, such as debris, the blockage material must be removed, e.g. purged, from the passageway 52 in a head-cleaning operation. As will be apparent herein, the purge/clean system 22 associated with the printing system 20 of FIG. 1 is adapted to readily purge air and blockage matter from the orifice 48 and passageway 52 in an advantageous manner.

Figure 3:
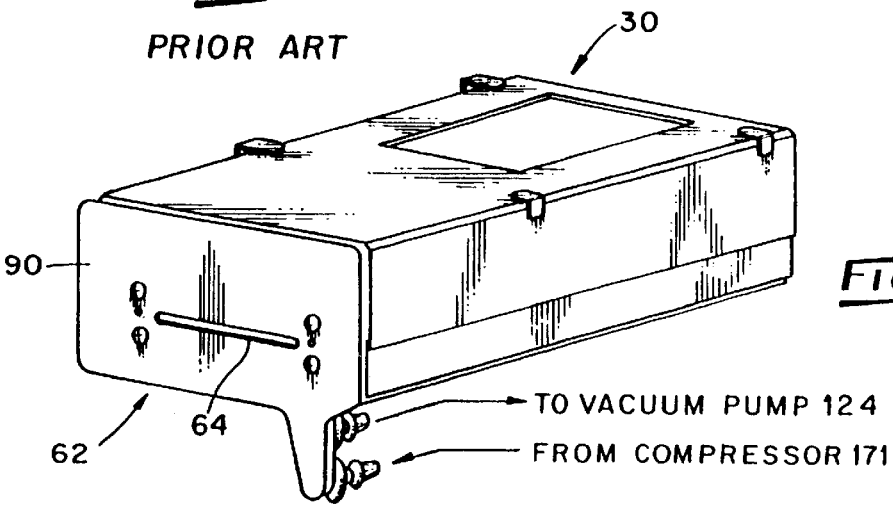
FIG. 3 is a perspective view of the printer head of the FIG. 1 printing system, shown with the cavity-providing assembly of the FIG. 1 purge/clean system attached thereto.
Figure 4:
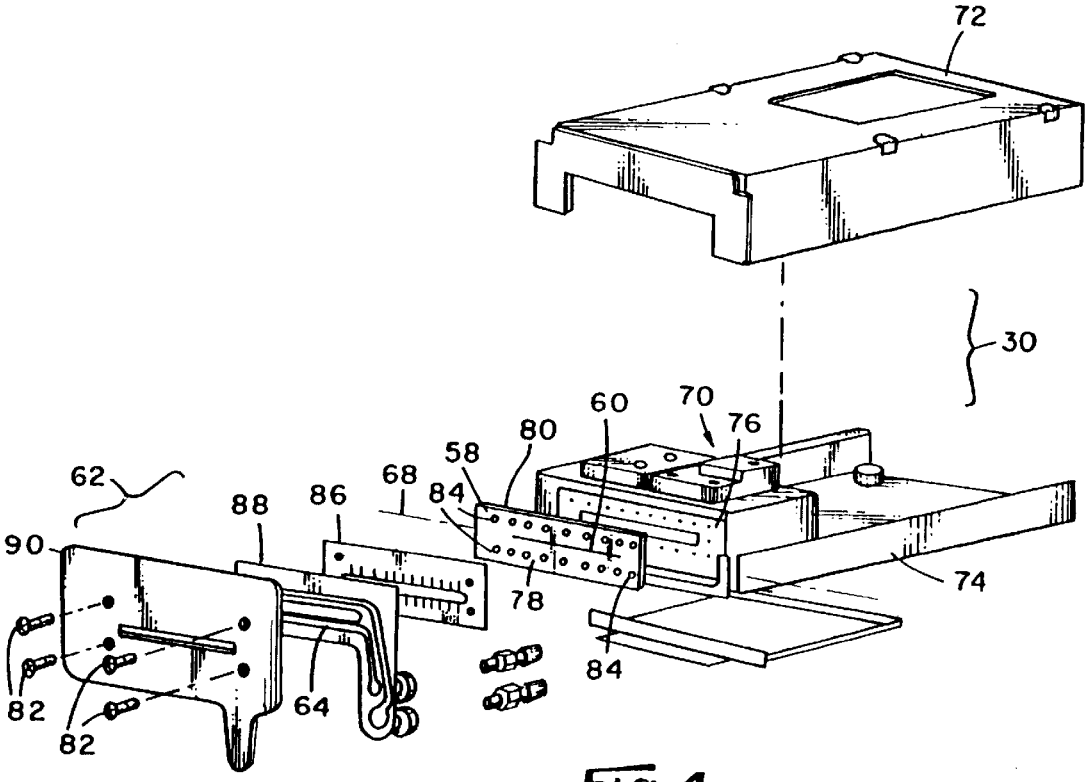
FIG. 4 is a perspective view of the printer head of FIG. 3, shown exploded.
Figure 10:
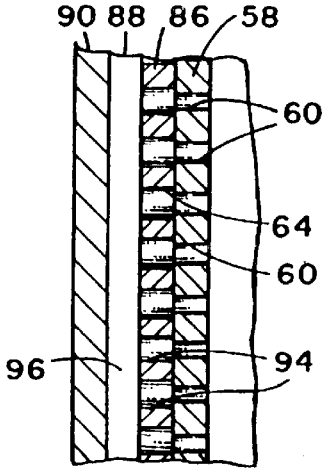
FIG. 10 is a cross-sectional view taken about along line 10—10 of FIG. 9.

With the foregoing in mind and with reference to FIGS. 3 and 4, the printer head 30 of the ink jet printing system 20 of FIG. 1 includes a face plate 58 (FIG. 4) through which a linear row of orifices 60 are defined, and the purge/clean system 22 incorporated within the FIG. 1 system 20 includes means, generally indicated 62, associated with the face plate 58 for providing, or defining, a collection cavity 64 (best shown in FIG. 10) adjacent the face plate 58 for collecting ink which has been expelled from the printer head 30 by way of the orifices 60 and means, generally indicated 66 in FIG. 1, for withdrawing the ink which is collected, or contained, within the collection cavity 64. In addition to the face plate 58 and as best shown in the exploded view of FIG. 4, the printer head 30 also includes an internal operating (i.e. piezoelectric-based) componentry, generally indicated 70, within which ink-moving piezoelectric devices are supported and outer housing members 72, 74 which are secured about the componentry 70. The internal componentry 70 includes a mount 76 to which the face plate 58 is attached so that the face plate 58 is held in a stationary condition against the front of the componentry 70.

The face plate 58 has front and rear surfaces 78, 80, respectively, and its row of orifices 60 are arranged along a line 68 which extends centrally along the length of the plate 58. In addition, the face plate 58 has a rectangular outer periphery and is attached to the mount 76 with several (e.g. sixteen total) screws 82 which are inserted through screw-accepting openings 84 provided along the face plate 58 and are threadably received by internally-threaded openings provided in the mount 76. As will be apparent herein, four of the screws 82 which are secured at the corners of the face plate 58 are removed from the face plate 58 and, in turn, used to secure the cavity-providing means 62 to the mount 76 with the same screw holes in the face plate 58.

Although the collection cavity 64 can be formed by any of a number of components and in any of a number of configurations, the depicted collection cavity 64 is formed by appropriately-shaped cutouts and grooves, described herein, formed in a plurality of cavity-providing plate members, or plates 86, 88 and 90, which are arranged in an overlying, or stacked, relationship against the front surface 78 of the face plate 58. Each plate 86, 88 and 90 is relatively thin and is held in a stationary relationship against the face plate 58 with screws 82 (e.g. the aforementioned four screws 82) and mount openings which are used to attach the face plate 58 to the mount 76. Accordingly, each of the cavity-providing plates 86, 88 and 90 is provided within screw-accepting openings 91 defined at the corners of the plates 86, 88 and 90 which can be aligned with the screw-accepting openings 84 of the face plate 58 for acceptance of the shanks of the screws 82 so that the plates 86, 88 and 90, along with the face plate 58, are tightly held between the heads of the screws 82 and the surface of the mount 76. In addition, each plate 86, 88 and 90 is provided with a pair of through-holes 93 for accepting alignment pins associated with the head 30 to facilitate the assembly of plates 86, 88 and 90 in an aligned condition.

Figure 5:
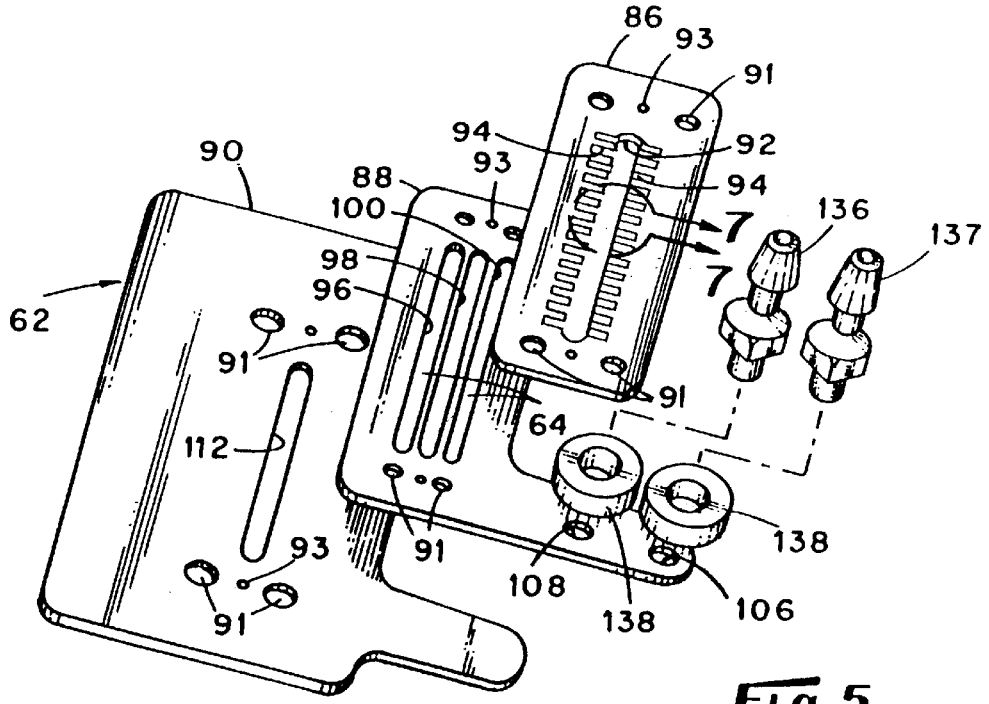
FIG. 5 is a view of the FIG. 3 cavity-providing assembly, shown exploded.
Figure 6:
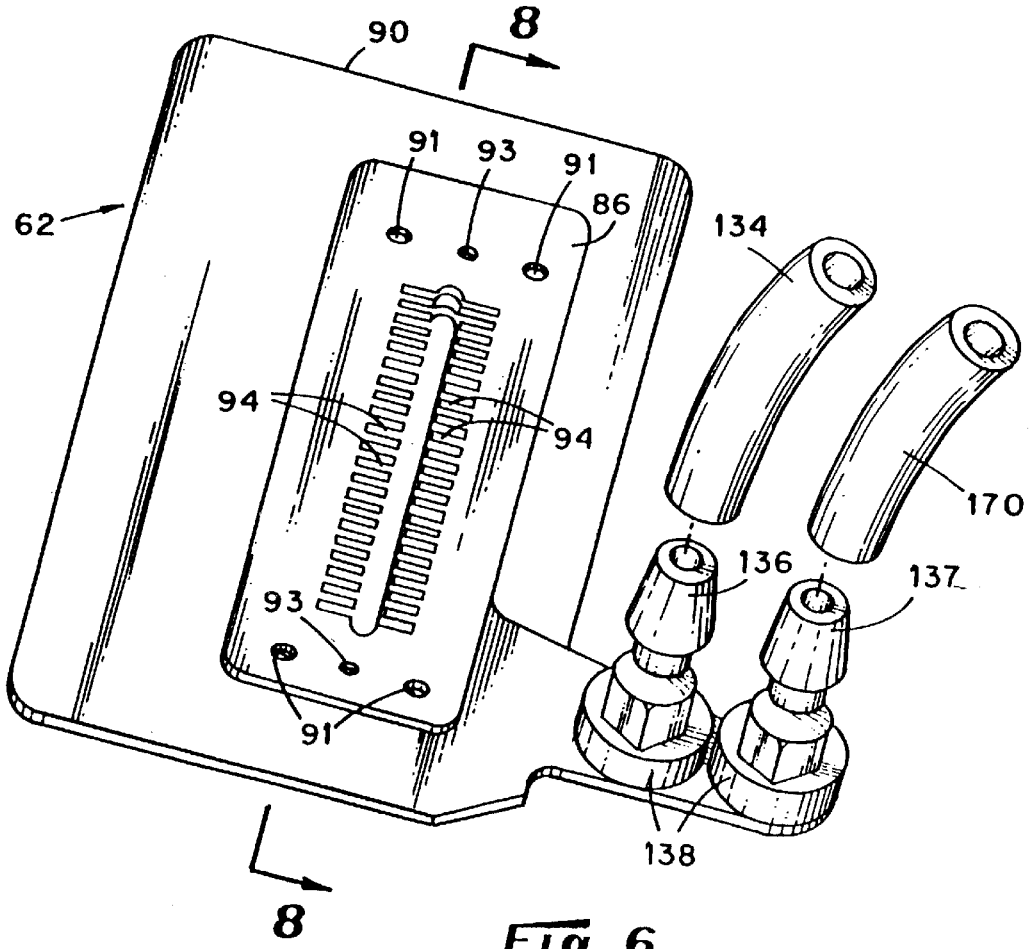
FIG. 6 is a view of the FIG. 3 cavity-providing assembly, shown assembled.

Within the depicted purge/clean system 22 and with reference to FIGS. 5 and 6, the cavity-providing plates 86, 88 and 90 of the cavity-providing means 62 includes a first plate 86 (referred to hereinafter as a gasket 86) which is positioned in contact with so as to substantially cover the front surface 78 of the face plate 58, a second, or flowover plate 88 which is positioned in contact with so as to substantially cover the front surface 78 of the gasket 86, and a third, or cover plate 90 which is positioned in contact with so as to substantially cover the front surface of the flowover plate 88.

Figure 7:
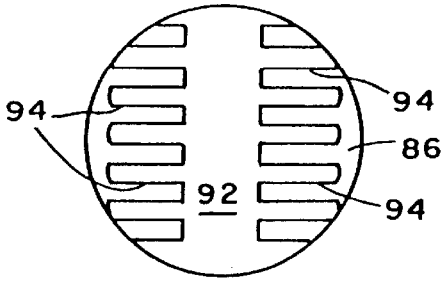
FIG. 7 is a view of a fragment of the gasket of the cavity-providing assembly as seen in the circle labeled 7—7 in FIG. 5, but drawn to a slightly larger scale.

With reference to FIGS. 5–9, the gasket 86 is platen-like in form and has outer, substantially rectangular dimensions which conform generally to those of the face plate 58. In addition, the gasket 86 includes a through-opening 92 which extends along the length of the gasket 86 and opposing rows of notches 94 which communicate with the through-opening 92 (as best shown in FIG. 7) so that the notches 94 extend laterally from the through-opening 92. The material out of which the gasket 86 is constructed can be any of a number of materials, but is preferably stainless steel.

Figure 11:
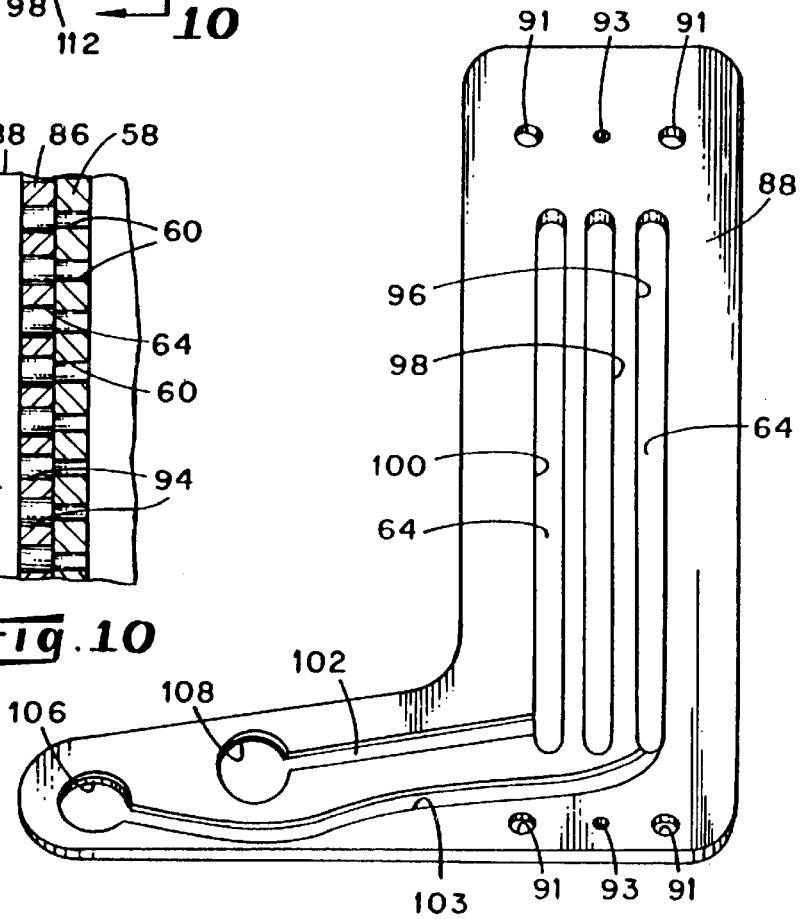
FIG. 11 is a view of the flowover plate of the FIG. 6 assembly as seen from the back in FIG. 5.

The flowover plate 88 (best shown in FIGS. 5 and 11) is also platen-like in form, but has somewhat of an L shape, and includes three parallel slot-like through-openings 96, 98, 100 which extend linearly along the length of the plate 88. The (middle) through-opening 98 positioned between the other two (outer) through-openings 96 and 100 is positioned so as to be aligned with the through-opening 92 of the gasket 86, and the two outer through-openings 96, 100 are positioned so as to communicate with the notches 94 of the gasket 86 when the flowover plate 88 is positioned in its operative, overlying relationship with the gasket 86. Furthermore and as best shown in FIG. 11, there is defined along one leg of the L-shape of the plate 88 (and along the side thereof opposite the gasket 86) a pair of grooves 102, 103 which extend from one end (i.e. the lower end) of the outer through-openings 96, 100 to a pair of internally-threaded apertures, or through-bores 106, 108, formed adjacent the end of the corresponding leg of the L-shape of the plate 88.

The cover plate 90 (best shown in FIGS. 5 and 6) is plate-like in form having somewhat of an L-shape which corresponds generally to that of the flowover plate 88 and is provided with a slot-like through-opening 112 which extends substantially centrally therealong. The material out of which each of the flowover plate 88 and the cover plate 90 is constructed is stainless steel, although other materials can be used.

Figure 8:
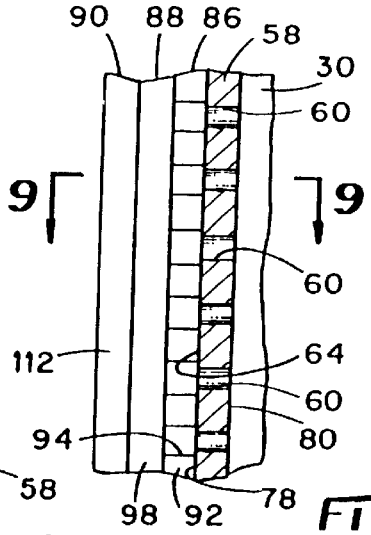
FIG. 8 is a longitudinal cross-sectional view of a fragment of the FIG. 6 assembly taken generally along lines 8—8 of FIG. 6.
Figure 9:
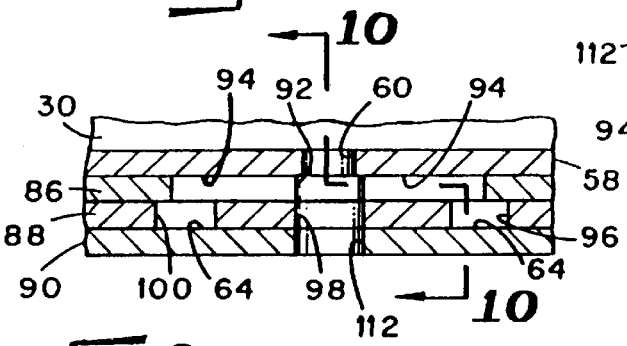
FIG. 9 is a cross-sectional view taken about along line 9—9 of FIG. 8.

When the gasket 86, flowover plate 88 and cover plate 90 are connected to the face plate 58 (with the aforementioned four screws 82) in the aforedescribed overlying relationship and as best shown in FIGS. 8 and 9), the orifices 60 provided within the face plate 58 are aligned with the central through-opening 92 of the gasket 86, the middle through-opening 98 of the flowover plate 88 and the through-opening 112 of the cover plate 90. With the through-openings 92, 98 and 112 aligned with the orifices 60 in this manner, ink which is forcibly pushed through the orifices 60 by way of the piezoelectric devices mounted in the printer head 30 is permitted to travel toward a target surface, or substrate, unobstructed by the cavity-defining plates 86, 88 and 90. In practice, the printer head 30 of the depicted printing system 20 has a maximum throw distance, or distance that the ink is accurately thrown from the orifices 60, of about 0.25 inches. Consequently, it is preferred that the collective thicknesses of the gasket 86 and plates 88 and 90 total no more than about 0.10 inches to enable a target surface, e.g. the side of the carton 26, to pass across the front of the cover plate 90 in close proximity, i.e. within about 0.25 inches, of the orifices 60.

It also follows from the foregoing that with the gasket 86, flowover plate 88 and cover plate 90 connected to the face plate 58 in the aforedescribed overlying relationship, a pair of continuous passages extend between the orifices 60 and the through-bores 106, 108 of the flowover plate 88 by way of the notches 94, outer through-openings 96, 100 and grooves 102, 103. Therefore, the orifices 60 communicate with the through-bore 106 by way of the outer through-opening 96 and groove 103, while the orifices 60 also communicate with the through-bore 108 by way of the outer through-opening 100 and groove 102. As will be explained in greater detail herein, a vacuum is drawn in the cavity 64 by way of the through-bore 108 during a purging or head-cleaning operation while pressurized air is introduced into the cavity 64 by way of the through-bore 106 so that a flow of air is induced across the orifices 60 from the through-opening 96 toward the through-opening 100. This induced air flow, as well as the canted condition of the head 30 (as shown in FIG. 1) which disposes the (pressurized) through-opening 96 above the through-opening 100, effects the flow of ink which is expelled from the orifices 60 during a purging or cleaning operation into the through-opening 100, rather than into the through-opening 96. Consequently and due to the influence of gravity and the induced flow of air from the through-opening 96 toward the through-opening 100, ink which is expelled from the orifices 60 during a purging or cleaning operation flows into the portion of the cavity 64 provided by the through-opening 100, rather than into the portion of the cavity 64 provided by the through-opening 96.

Figure 12:
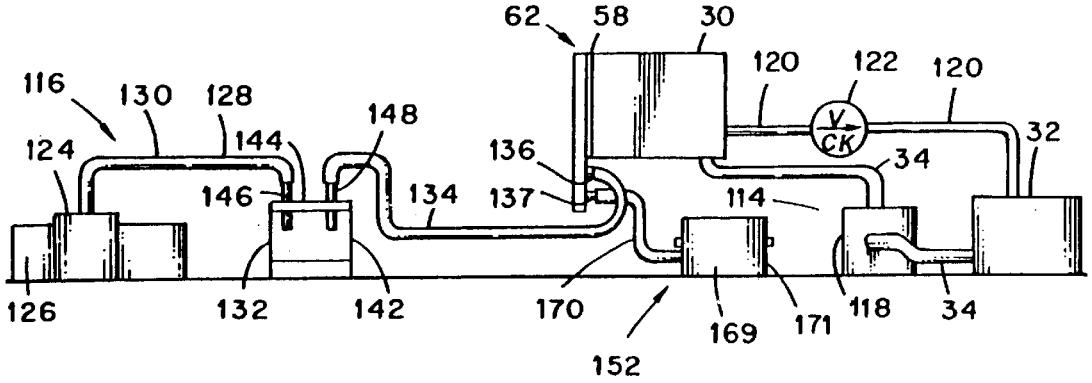
FIG. 12 is a view illustrating schematically the purging, withdrawing and pressure-creating means of the FIG. 1 purge/clean system.
Figure 13:
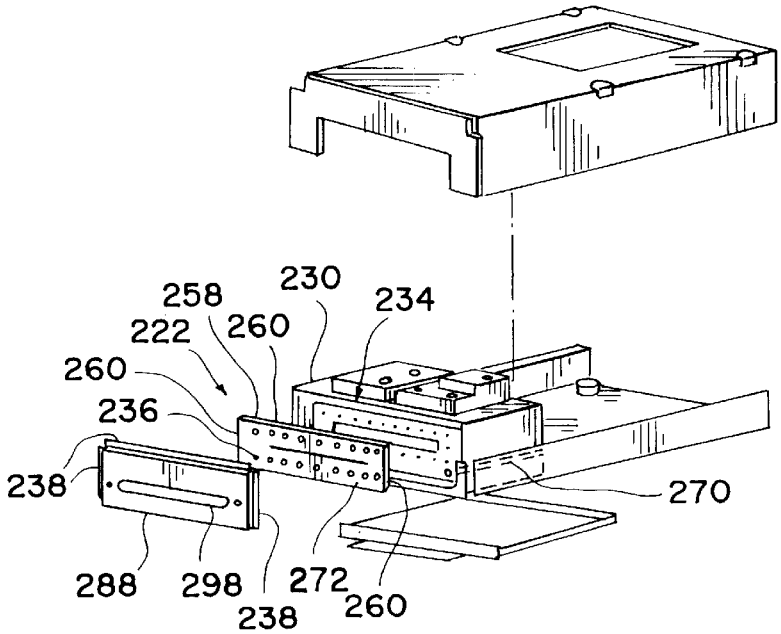
FIG. 13 is a perspective view of a print head, similar to FIG. 4, illustrating an alternate embodiment of portions of the purge/clean system.
Figure 14:
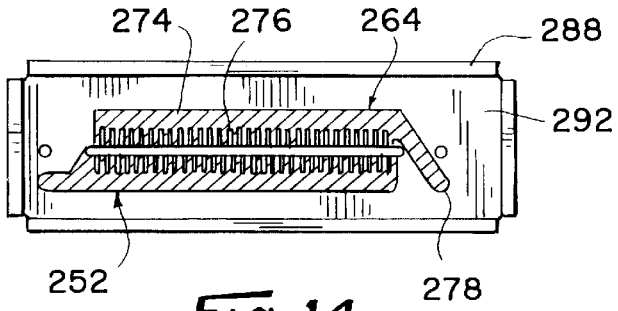
FIG. 14 is a rear view of the maintenance module plate of FIG. 13, showing the acid etched regions of the plate.
Figure 15:
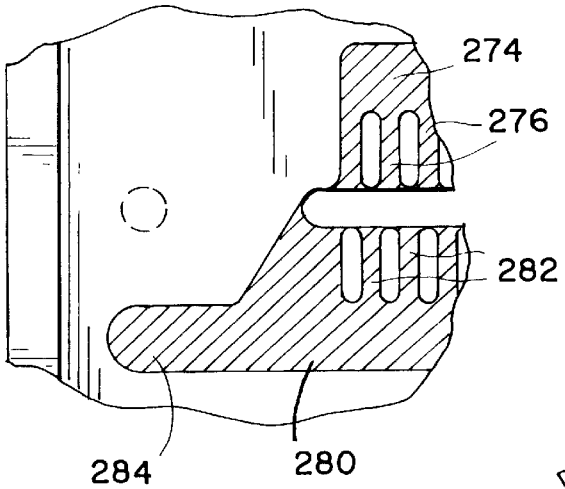
FIG. 15 is an enlarged view of the identified region of FIG. 14, illustrating the etched pattern in the plate.

In addition to the cavity-providing means 62 and with reference to FIGS. 1 and 12, the depicted purge/clean system 22 also includes means, generally indicated 114, for purging air from the ink flow passageways and blockage matter which has become lodged within the orifices 60 of the printer head 30 and means, generally indicated 116, for withdrawing ink which has been purged from the orifices 60 and is present upon the front surface of the face plate 58. In the depicted purge/clean system 22, the purging means 114 includes a purge pump 118 which is connected in-line with the conduit 34 leading to the printer head 30 for pumping, when desired, a small volume of ink through the conduit 34 from the supply 32 so that any air which is contained within the ink flow passageways and any blockage matter which is lodged within the orifices 60 is pushed, or expelled, through the orifices 60 along with the ink which is pumped through the printer head 30 by the purge pump 118. For relief of the pump-induced pressure within the printer head 30, a return line 120 (having a check valve 122 mounted therein) is connected between the printer head 30 and supply 32 so that some of the ink which is pumped to the printer head 30 by the pump 118 to return to the supply 32.

It follows that actuation of the purge pump 118 expels ink, as well as air and blockage matter, from the orifices 60 of the printer head 30, and this expelled ink ordinarily would flow downwardly along the front surface 78 of the face plate 58. However, the cavity-providing means 62 described above prevents the exposure of this expelled ink to surfaces which are desired to be kept clean and the withdrawing means 116 cooperates with the through-opening 100 of the cavity-providing means 62 to remove this expelled ink from the face plate 58 so that ink in prevented from accumulating upon the face plate 58.

With reference still to FIGS. 1 and 12, the withdrawing means 116 of the depicted purge/clean system 22 includes a vacuum pump 124, a controller 126 within which the vacuum pump 124 is mounted, and an air flow network 128 connected between the vacuum pump 124 and the through-bore 108 of the flowover plate 88. The air flow network 128 of the depicted system 22 includes a first vacuum hose 130 which is connected between a collection reservoir assembly 132 and the inlet of the vacuum pump 124 and a second vacuum hose 134 which is connected between the collection reservoir assembly 132 and the through-bore 108 (FIG. 5) of the flowover plate 88. To facilitate the attachment of the vacuum hose 134 to the flowover plate 88, an air hose connector 136 (FIGS. 5 and 6) is threadably received by the through-bore 108, and a sealing ring 138 is interposed between appropriate surfaces of the connector 136 and the flowover plate 88 to seal the connector 136 to the plate 88.

With reference again to FIGS. 1 and 12, the collection reservoir assembly 132 includes a reservoir 142 and a lid 144 through which a pair of conduit segments 146, 148 extend. Each conduit segment 146 or 148 is connected to a corresponding one of the vacuum hoses 130 or 134, and the lid 144, reservoir 142 and conduit segments 146, 148 are sealingly connected to one another to prevent leakage of the vacuum created by the pump 124 through the air flow network 128. Control of the operation of the vacuum pump 124, as well as the purge pump 118, is had by way of suitable controls mounted within the controller 126 and which are appropriately wired to the vacuum pump 124 and the purge pump 118.

During operation of the purge/clean system 22, the vacuum pump 124 is actuated to draw air toward the pump 124 from the cavity 64 of the cavity-providing means 62 through the air flow network 128, and the operation of the purge pump 118 is initiated to pump a low volume of ink through the printer head orifices 60 so that any air which may be present in the ink passageways and any blockage matter which is lodged within the orifices 60 of the printer head 30 is expelled through the orifices 60. Since the interior of the cavity 64 of the cavity providing means 62 communicates with the atmosphere by way of the notches 94 and aligned through-openings 92, 98, 112 of the gasket 86 and plates 88, 90, air is permitted to be pulled from the atmosphere and so that air flows in sequence toward the vacuum pump 124 through the cavity 64 of the cavity-providing means 62 and then through the air flow network 128 by way of the groove 102 and through-bore 108.

Therefore, any ink which is expelled from the orifices 60 during an air-purging or head-cleaning operation and which begins to flow downwardly along the front surf ace 78 of the face plate 58 is drawn through the notches 94 and into the outer through-opening 100 of the flowover plate 88 by the influence of the vacuum pump 124, as well as by the influence of gravity. Consequently, the gasket 86 acts as a manifold through which ink is permitted to be drawn into the outer through-opening 100 of the flowover plate 88 from the front surface 78 of the face plate 58. Once the ink enters the through-opening 100, it is drawn downwardly by the vacuum pump 124 (as well as by the influence of gravity) toward the through-bore 108 where it is drawn through the air flow network 128 toward the vacuum pump 124. Therefore, the through-opening 100 and groove 102 act as flow channels through which the expelled ink moves downwardly through the cavity-providing means 62. Upon reaching the collection reservoir 142 (FIG. 12) by way of the air flow network 128, the ink falls from the inlet conduit segment 148 and is collected within the reservoir 142 for reuse or disposal. Since ink separates from the combined air and ink contents drawn through the air flow network 128 at the reservoir 142, only air is moved along the vacuum hose 130 which extends from the reservoir 142 to the vacuum pump 124.

The operation of the purge/clean system 22 can be initiated, for example, by pressing of "start" switch associated with the controller 126 which, in turn, actuates the vacuum pump 124 and the purge pump 118. Shut-off of the vacuum and purge pumps 124, 118 can be effected after a predetermined period of time (e.g. a few seconds) with appropriate timing controls. The ability to manually initiate operation of the purge/clean system 22 is advantageous when, or if, air becomes entrained within any ink flow passageway of the printer head 30 during operation or any of the orifices 60 become blocked, and it is desired that a purging operation be initiated immediately to rectify the situation. In the alternative or in addition, actuation of the purge/clean system 22 can be automatically initiated at predetermined intervals to ensure that the orifices 60 or ink flow passageways of the printer head 30 are free from air and orifice-blockage matter following those predetermined intervals. For example, with appropriate programmable componentry mounted within the controller 126, the controller 126 can be programmed to automatically initiate an operating cycle of the purge/clean system 22 at the initiation of an assembly line operation to ensure that the printer head 30 is free from air and blockage matter at start-up of operation.

If the purge pump 118 which is selected for use with the purging means 114 possesses appreciably more strength than the vacuum pump 124, it may desirable that the purge pump 118 be operated intermittently, rather than continuously, during the operation of the vacuum pump 124. To this end, the controls of the controller 126 can be selected (or programmed) to intermittently actuate and de-actuate the purge pump 118 while the vacuum pump 124 is operated during an operating cycle of the purge/clean system 22.

It follows from the foregoing that a purge/clean system 22 has been described which removes ink from the front surface 78 of the face plate 58 during an air-purging and head-cleaning operation performed upon the printer head 30. Consequently, the face plate 58 of the printer head 30 is maintained relatively free of ink which is expelled from the orifices 60 during an air-purging and head-cleaning operation, and no manual methods are needed to wipe ink from the front of the printer head 30 to prevent the expelled ink from contacting or marking a surface desired to remain free of ink.

It is also a feature of the purge/clean system 22 that it includes means, generally indicated 152 in FIGS. 1 and 12, for creating a zone of above-atmospheric pressure in a region adjacent the front plate 58 of the printer head 30 of a printing system to help maintain the orifices 60 of the front plate 58 relatively clean, or in other words, free of matter, such as unwanted dust and debris, which could otherwise become lodged within the orifices 60. In the depicted system 22, the creating means 152 utilizes the cavity 64 of the cavity-providing means 62, and this provided cavity 64 surrounds the region adjacent the front plate 58 within which the zone of above-atmospheric pressure is desired to be created.

Furthermore, the creating means 152 also includes a source, indicated 169, of pressurized air, which can be a fan or a compressor 171, which is situated to one side of the printer system 20 and further includes a conduit 170 connected between the pressurized air source 169 and the through-bore 106 for conducting the pressurized air from the source 169 to the portion of the cavity 64 provided by the through-opening 96. In this connection, an air flow connector 137 (FIGS. 5 and 6) is threadably received by the through-bore 106, and the conduit 170 is joined to the connector 137. The connector 137 is sealed against the flowover plate 88 with a sealing ring 138. Therefore, during operation of the pressure-creating means 152, air from the pressurized air source 169 is conducted into the through-opening 96 of the cavity 64 by way of the conduit 170 and connector 137 so that the internal pressure of the cavity 64 exceeds atmospheric pressure.

In practice, the internal pressure of the cavity 64 need not exceed atmospheric pressure by an appreciable amount (and can, in fact, be as small as 1.0 psig) to develop an environment within the cavity 64 wherein any leakage of air out of the cavity 64, such as through the aligned through-openings 92, 98, 112 will reduce any likelihood that unwanted dust or debris will collect at, and thereby lodge within, the orifices 60. Consequently, the pressure of the air delivered to the cavity 64 from, the source 169 need not be very great so that the energy expended to pressurize the air at the source 169 can (for energy-conserving measures) be relatively small.

As long as the pressure-creating means 152 is operating, the likelihood that unwanted dirt or dust will lodge within and block the orifices 60 of the printer head 30 is relatively small. Consequently, it is preferable that the pressure-creating means 152 be operated continually—even during printing operations performed with the printing system with which the purge/clean system 22 is used. During simultaneous operation of the purge/clean system 22 and the pressure-creating means 152 and as mentioned earlier, ink which is expelled from the orifices 60 during a purging or head-cleaning operation is forced to flow, under the influence of gravity and an induced flow of air across the orifices 60 from the through-opening 96 toward the through-opening 100, into the through-opening 100 of the cavity 94 for collection, rather than into the through-opening 96.

It will be understood that numerous modifications and substitutions can be had to the aforedescribed system without departing from the spirit of the invention. For example, although the aforedescribed purge/clean system 22 has been shown and described as including purging means 114 for forcing ink through the face plate orifices 60 during a purging or head-cleaning operation, the cavity-providing means 62 and the withdrawing means 116 can be used without the purging means 114 to retrofit the printer head of an existing ink jet printing system so that ink which is expelled from the face plate with conventional purging means associated with the printing system can be removed with the cavity-providing means 62 and the withdrawing means 116.

An alternate embodiment of a portion of the purge/clean system 222 is shown in FIGS. 13–16. In this embodiment, the vacuum and air pressure conduits 234, 270 are formed as part of the print head 230, rather than as separate conduits as shown in the embodiment exemplified in FIG. 6. That is, both conduits 234, 270 penetrate the head 230 and provide openings 236, 272 at the face plate 258. In this embodiment, a single plate , as indicated at 288, is used to provide a cavity 264 that is used for ink withdrawal and a cavity 252 to provide positive air pressure. The plate 288 is commonly referred to as maintenance module.

The plate 288 includes a front surface 290, which is that surface opposing the surface on which printing is carried out (e.g., the target), and a rear surface 292 that abuts the print head face plate 258. The plate 288 includes a slot-like opening 298 through which the ink is propelled onto the target. This slot-like opening 298 corresponds to openings 92, 98 and 112 of the previously described embodiment.

The ink withdrawal cavity 252 is formed as a vacuum channel, indicated generally at 274, formed in the rear surface 292 of the plate 288. A plurality of finger-like notches 276 are formed in the plate 288, and extend between the vacuum channel 274 and the slot opening 298. The notches 276 thus provide flow communication between the slot 298 and the vacuum channel 274. In a current embodiment, the channel 274 is oriented generally parallel to the slot 298 and the notches 276 are formed transverse to both the slot 298 and the channel 274.

The channel 274 terminates at an end 278 that corresponds to the vacuum opening 236 in the face plate 258. In this manner, the channel 274, at about the end 278, overlies the vacuum opening 236 in the face plate 258. Thus, vacuum is provided to the plate 288 (and thus to the slot 298, via the notches 276) by direct communication of the opening 236 to the channel 274.

The positive pressure air cavity 252 is formed as a purge or positive pressure channel 280, and is also formed in the rear surface 292 of the plate 288. Like the vacuum channel 274, the purge channel 280 is oriented generally parallel to the slot 298, and finger-like notches 282 extend between the slot 298 and the channel 280. The purge channel 280 terminates at an end 284 that overlies the purge or pressure opening 272 formed in the face plate 258. Air is provided at a positive pressure to the slot 298 (by the channel 280 via the notches 282) to carry out the purge functions described above.

In the illustrated embodiment, the vacuum and purge channels 274, 280 are formed in the plate 288, generally parallel to one another, on opposing sides of the slot 298. In a preferred embodiment, the vacuum channel 274 is disposed above the slot 298, and the channel end 278 is at a downward incline or angle relative to the main portion of the channel 274. In this manner, as ink is drawn from about the slot 298, it flows downward, with gravity, toward the vacuum opening 236 in the face plate 258.

Conversely, the purge channel 280 is located below the slot 298 and the purge air flow is upward into the slot 298. The purge channel end 284 is formed generally aligned with the main portion of the channel 280.

In a present embodiment, the plate 288 has a thickness of about 0.010 inches (about 10 mils), and the channels 274, 280 and notches 276, 282 are formed by acid etching. The acid etched areas have a depth of about 5 mils. It has been found that this plate 288 thickness and etching depth provides sufficient rigidity to the plate 288 and sufficient flow capabilities at the channels 274, 280 and notches 276, 282 to carry out the vacuum and purge functions for the maintenance module. Other depths, methods and manners for forming the channels and notches will be recognized by those skilled in the art and are within the scope and spirit of the present invention.

A further enhancement of the alternate maintenance module is that it is configured to readily install on the print head 230, over the face plate 258. In a current embodiment, clip-like portions 238 extend rearwardly from the plate 288, generally transverse thereto. The clips 238 are urged over, and engage sides 260 of the face plate 258 to secure the maintenance module plate 288 by a snap-fit. This arrangement reduces or eliminates the need for screws or other fasteners to secure the maintenance module plate 288 to the print head 230. Thus, by a simple frictional or snap-fit over the printing head face plate 258, the maintenance module plate 288 is held in place.

The snap-fit configuration permits two or more of the otherwise used fastener or screw openings to be used to provide the vacuum and purge openings 236, 272 in the print head face plate 258. Thus, the print head 230 can be configured so that the internally carried conduits 234, 270 have little to no impact on the overall size of the print head 230. In addition, the snap-fit configuration also permits readily aligning the plate 288 over the face plate 258. Such alignment is necessary to assure that the jetted ink is directed through the slotted opening 298 in the plate and onto the target for printing.

Additionally, it has been found that during operation, contaminants can be inadvertently spread onto the maintenance module plate 288. For example, in a packaging line operation, such as a boxing or crating operation in which an adhesive is applied to the boxes or crate, ribbons of adhesive can be land on the front surface 290 of the plate 288. As will be appreciated by those skilled in the art, this adhesive must be removed, so that it does not build up on the surface 290 of the plate 288, in order to maintain proper operation of the print head 230.

Figure 16:
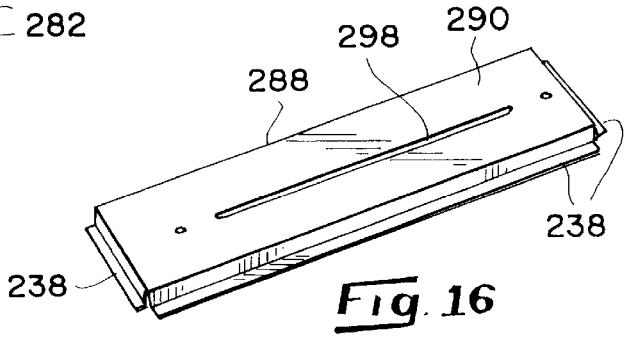
FIG. 16 is a front perspective view of the plate of FIG. 14 illustrating the mounting clips for mounting the plate to the printer head.

A maintenance module 288 in accordance with the present invention can include a coating or layer, as indicated at C in FIG. 16, of a low friction material thereon. A present material is a fluoropolymer, such as TEFLON® or the like. Such a material facilitates readily cleaning the front surface 290 of the plate 288 in the event that the plate 288 becomes dirty or contaminated by, for example, adhesive ribbons and the like. Other readily cleaned, low friction materials will be recognized by those skilled in the art, and are within the scope and spirit of the present invention.

From the foregoing it will be observed that numerous modifications and variations can be effectuated without departing from the true spirit and scope of the novel concepts of the invention. It is to be understood that no limitation with respect to the specific embodiment illustrated is intended or should be inferred. The disclosure is intended to cover by the appended claims all such modifications as fall within the scope of the claims.

What is claimed is:

1. An apparatus for purging air, surface blockage or internal blockage from a fluid jet apparatus during a purging or cleaning operation, the fluid jet apparatus having at least one orifice through which fluid is ejected by the fluid jet apparatus during a jetting operation, the fluid jet apparatus having a vacuum opening and a purge opening formed therein, the apparatus comprising:

a plate defining an opening therein, the plate configured to overlie a portion of the fluid jet apparatus with the plate opening overlying the fluid jet apparatus orifice, the plate having a vacuum channel and a purge channel, a portion of the vacuum channel overlying the vacuum opening in the fluid jet apparatus and a portion of the purge channel overlying the purge opening in the fluid jet apparatus, each the vacuum channel and the purge channel being in flow communication with the opening in the plate.

2. The apparatus in accordance with claim 1, wherein the opening in the plate is an elongated slot.

3. The apparatus in accordance with claim 2, wherein vacuum and purge channels are elongated channels extending generally parallel to the elongated slot.

4. The apparatus in accordance with claim 3 wherein the vacuum and purge channels are disposed on opposing sides of the elongated slot.

5. The apparatus in accordance with claim 4 wherein each the vacuum and the purge channels includes a plurality of notches extending between a respective channel and the slot.

6. The apparatus in accordance with claim 5 wherein the notches extend generally transverse to and between their respective channels and the elongated slot.

7. The apparatus in accordance with claim 1 wherein the vacuum and purge channels are formed in the plate by acid etching.

8. The apparatus in accordance with claim 1 wherein the plate includes clips for mounting to the fluid jet apparatus.

9. The apparatus in accordance with claim 8 wherein the clips extend about at least three sides of the plate.

10. The apparatus in accordance with claim 1 wherein the plate defines a front side and a rear side, the rear side abutting the ink jet apparatus, and wherein the front side has a low friction coating thereon.

11. The apparatus in accordance with claim 10 wherein the low friction coating is a fluoropolymer.

12. The apparatus in accordance with claim 1 wherein the plate is a single, unitary plate.

13. A fluid jet apparatus for jetting a fluid onto a target, comprising:

a body having at least one orifice through which fluid is ejected by the fluid jet apparatus during a jetting operation;

a face plate carried by the body, the face plate having an orifice therein through which the fluid is ejected, the face plate further including a purge opening and a vacuum opening formed therein;

a vacuum source operably connected to the vacuum opening;

a pressurized air source operably connected to the purge opening; and a cover plate defining an opening therein configured to overlie a portion of the fluid jet apparatus with the cover plate opening overlying the face plate orifice, the cover plate having a vacuum channel and a purge channel formed therein, a portion of the vacuum channel overlying the vacuum opening in the face plate and a portion of the purge channel overlying the purge opening in the face plate, each the vacuum channel and the purge channel being in flow communication with the opening in the plate, the purge channel and the vacuum channel configured for cooperating with the vacuum source and the pressurized air source to purge air, surface blockage or internal blockage from the fluid jet apparatus during a purging or cleaning operation.

14. The apparatus in accordance with claim 13, wherein the opening in the cover plate is an elongated slot.

15. The apparatus in accordance with claim 14, wherein vacuum and purge channels are elongated channels extending generally parallel to the elongated slot.

16. The apparatus in accordance with claim 15 wherein the vacuum and purge channels are disposed on opposing sides of the elongated slot.

17. The apparatus in accordance with claim 16 wherein each the vacuum and the purge channels includes a plurality of notches extending between a respective channel and the slot to provide flow communication between the respective channels and the slot.

18. The apparatus in accordance with claim 17 wherein the notches extend generally transverse to and between their respective channels and the elongated slot.

19. The apparatus in accordance with claim 13 wherein the vacuum and purge channels are formed in the plate by acid etching.

20. The apparatus in accordance with claim 13 wherein the cover plate includes clips for mounting to the face plate.

21. The apparatus in accordance with claim 20 wherein the clips extend about at least three sides of the cover plate.

22. The apparatus in accordance with claim 20 wherein the clips are integral with the cover plate.

23. The apparatus in accordance with claim 13 wherein the cover plate defines a front side and a rear side, the rear side abutting the face plate, and wherein the front side has a low friction coating thereon.

24. The apparatus in accordance with claim 23 wherein the low friction coating is a fluoropolymer.

25. The apparatus in accordance with claim 13 wherein the plate is a single, unitary plate.

* * * * *